US011364938B2

(12) United States Patent
Shah

(10) Patent No.: US 11,364,938 B2
(45) Date of Patent: Jun. 21, 2022

(54) RAIL CLAMP WITH STRAIGHT LINE TOOL

(71) Applicant: HARSCO TECHNOLOGIES LLC, Fairmont, MN (US)

(72) Inventor: Shaishav Shah, West Columbia, SC (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 421 days.

(21) Appl. No.: 16/445,424

(22) Filed: Jun. 19, 2019

(65) Prior Publication Data

US 2020/0001902 A1 Jan. 2, 2020

Related U.S. Application Data

(60) Provisional application No. 62/690,498, filed on Jun. 27, 2018.

(51) Int. Cl.

| | |
|---|---|
| ***B61D 15/00*** | (2006.01) |
| ***E01B 29/16*** | (2006.01) |
| ***B61F 5/52*** | (2006.01) |
| ***B61F 5/32*** | (2006.01) |

(52) U.S. Cl.

CPC ..... *B61D 15/00* (2013.01); *B61F 5/325* (2013.01); *B61F 5/52* (2013.01); *E01B 29/16* (2013.01)

(58) Field of Classification Search

CPC . B61D 15/00; B61F 5/325; B61F 5/52; E01B 29/16

See application file for complete search history.

(56) References Cited

FOREIGN PATENT DOCUMENTS

| | | | | |
|---|---|---|---|---|
| CN | 201317375 | | 9/2009 | |
| CN | 105346555 | | 2/2016 | |
| FR | 2731239 | | 9/1996 | |
| GB | 2043137 | | 10/1980 | |
| JP | 4454828 | | 4/2010 | |
| KR | 10-1509219 | | 4/2015 | |
| KR | 101509219 | B1 * | 4/2015 | ..... B61K 7/06 |
| WO | WO 2016/193392 | | 12/2016 | |
| WO | WO-2016193392 | A1 * | 12/2016 | ..... B61H 7/12 |

OTHER PUBLICATIONS

International Search Report and Written Opinion Issued in Corresponding PCT Patent Application No. PCT/US2019/037867, dated Oct. 4, 2019.

International Preliminary Reporton Patentability issued in corresponding International Application No. PCT/US2019/037867 dated Oct. 22, 2020.

European Extended Search Report & Opinion, issued in corresponding European Application No. 19825913.7, dated Jan. 31, 2022.

* cited by examiner

*Primary Examiner* — Robert J McCarry, Jr.

(74) *Attorney, Agent, or Firm* — Norton Rose Fulbright US LLP

(57) ABSTRACT

The present disclosure generally relates to a rail vehicle that includes a chassis and a rail clamp assembly coupled to the chassis. The rail clamp assembly includes a fixed central member and a pair of lugs each extending outwardly from opposing sides of the fixed central member. The rail clamp assembly further includes a pair of arms respectively coupled to the lugs to thereby provide respective pivot points to permit rotation of the arms about the pivot points. A pair of gripping tool assemblies are disposed at respective lower portions of the arms and are coupled to one another via a guide rod.

18 Claims, 9 Drawing Sheets

RAIL CLAMP WITH STRAIGHT LINE TOOL

CROSS-REFERENCE TO RELATED APPLICATION

This application claims priority to U.S. Provisional Patent Application No. 62/690,498 filed on Jun. 27, 2018, the disclosure of which is hereby incorporated by reference in entirety.

BACKGROUND

Railroads are typically constructed to include a pair of elongated, substantially parallel rails, which are coupled to a plurality of laterally extending ties. The ties are disposed on a ballast bed of hard particulate material such as gravel. Railroads often require maintenance due to the continued wear and tear experienced by the track due to multiple rail vehicles traveling over the track. Rail maintenance operations that may include the use of the rail clamp described herein include anchor spreading, anchor squeezing, rail lifting, rail leveling and aligning operations, or any other maintenance operation where it is desired to grip the rail either before, during or after the maintenance operation.

Conventional rail clamps follow an arcuate path to gripping of the rail. That is, conventional gripping tools follow an arcuate path to grip the rails under the "T" of the I-beam profile of the rails. Rail clamps require a substantially higher gripping force (e.g., around 25,000 lbs.). To gain a higher gripping force, a large size cylinder or mechanical leverage may be used. A large size cylinder will require a bigger pump and bigger engine, otherwise the clamps will slow down the production rate. To avoid having to use a larger engine, pump and cylinder, it is preferable to use mechanical leverage to gain higher force at the rail gripping end with a relatively smaller cylinder, pump and engine.

Further, conventional rail clamps have difficulty gripping the rail that has deviated from the typical I-beam profile of the rail, such as areas of rail that have joint bars. In many cases, machines are not capable to work in the area where obstacles like joint bars are present due to the arcuate path of the clamping system. In such situations, human operators operating the rail maintenance equipment may have to manually work the rail clamp to obtain a desired gripping of the rail, or the rail clamp system requires a longer (e.g., twice as long) stroke cylinder to clear obstacles, which will slow down the equipment. This is time consuming and also presents safety risks as such risks increase any time an operator has to disembark from machinery he/she is operating.

Accordingly, improved rail clamps for addressing the aforementioned problems are desired.

BRIEF SUMMARY

The present disclosure generally relates to a rail clamp assembly having gripping tools that are capable of approaching the rail in a substantially horizontal direction. The rail clamp assembly includes a fixed workhead portion and a pair of pivotable arms coupled to the fixed workhead portion. The rail clamp assembly further includes a gripping tool assembly coupled to each arm. Each gripping tool assembly has a connector portion coupled to the arm via a pin, a tip holder coupled to the connector portion and a clamping tip coupled to the tip holder. The pin is movable in a substantially vertical direction. Further, a guide rod is coupled to each of the gripping tool assemblies. In this manner, the gripping tool is able to approach the rail in a substantially horizontal direction. Related methods are described.

BRIEF DESCRIPTION OF THE DRAWINGS

Reference is now made to the following descriptions taken in conjunction with the accompanying drawings.

DETAILED DESCRIPTION

Various embodiments of a rail clamp with straight line tool are described according to the present disclosure. It is to be understood, however, that the following explanation is merely exemplary in describing the devices and methods of the present disclosure. Accordingly, several modifications, changes, and substitutions are contemplated.

As described throughout, a railroad track may include a pair of elongated, substantially parallel rails, which may be coupled to a plurality of laterally extending rail ties. In some embodiments, a top surface of each rail tie may be coupled to a bottom surface of the rails. The rail ties may be disposed on a ballast bed of hard particulate material such as gravel (e.g., ballast, rocks, and/or the like) and may be used to support the rails. The railroad track may further include a variety of track features used for securing the rails to rail ties, the ground, and/or other structures. For example, track features such as spikes or anchors may be used to couple a rail to an underlying rail tie. Rail maintenance operations often require that railroad ties be replaced due to wear. In such operations, spikes are removed and the anchors are spread away from the ties to allow for removal of the old tie and insertion of the new tie. It is desirable to grip the rail in such operations in order to maintain it in place. Of course, other rail maintenance operations may require gripping, or clamping, of the rail, such as anchor squeezing, rail lifting, and rail leveling and aligning operations, for example. The tool described herein may be used to achieve the desired clamping of the rail.

Figure 1:
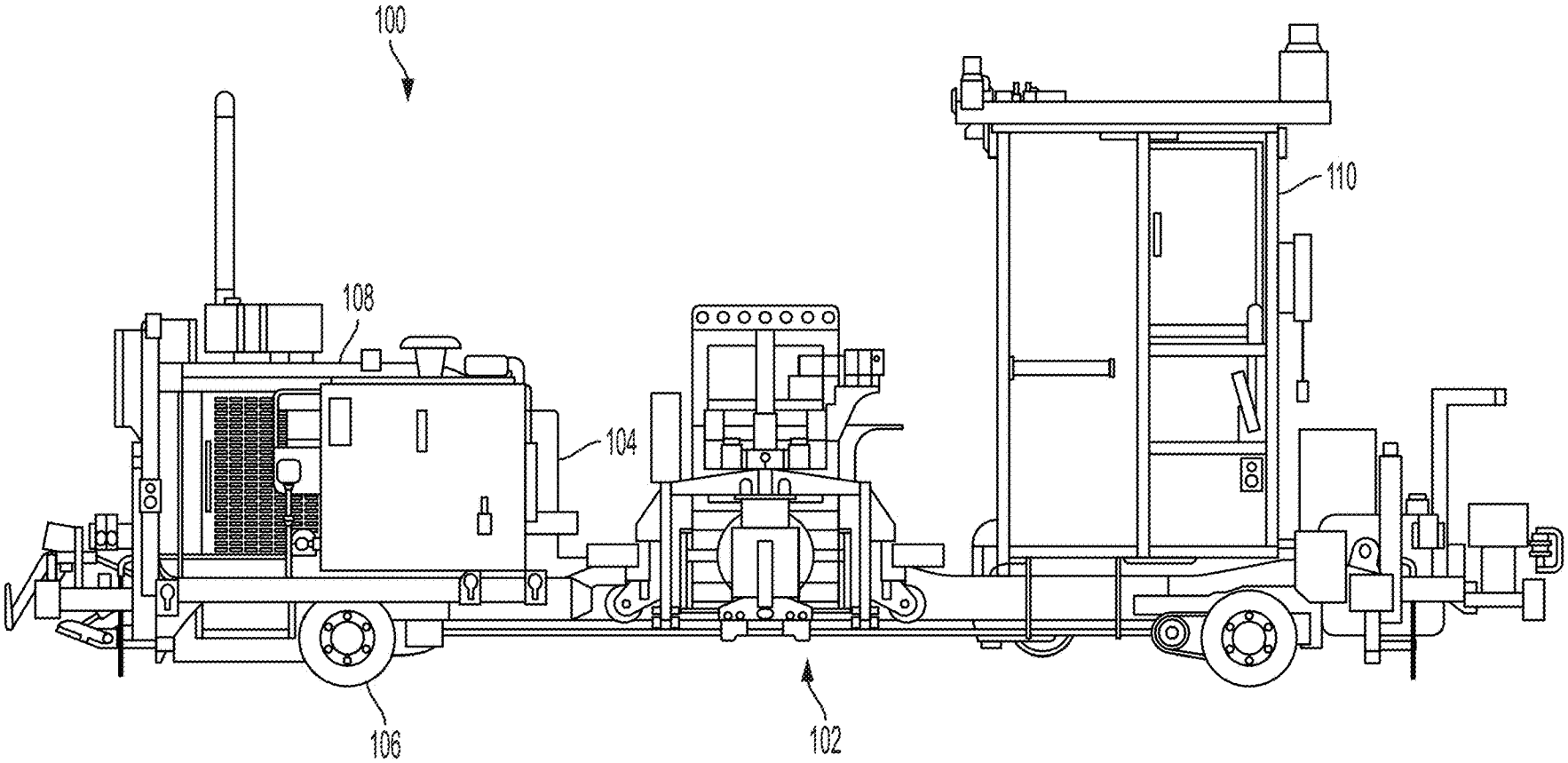
FIG. 1 illustrates an exemplary rail vehicle carrying a rail clamp assembly according to the present disclosure.

As shown in FIG. 1, a rail vehicle 100 for performing rail maintenance operations may include a rail clamp assembly 102 for gripping rail. The rail vehicle 100 includes a chassis 104 and rail wheels 106 coupled to the chassis for enabling the rail vehicle to travel along rail track. The rail vehicle 100 further includes a propulsion device 108 for propelling the rail vehicle along track. In some embodiments, the rail vehicle 100 may include an operator cabin 110 for housing an operator of the rail vehicle. However, in other embodiments, the operator cabin 110 may be removed and the rail vehicle 100 may operate as a drone or autonomous maintenance vehicle. In such embodiments, the drone vehicle does not have a human operator, but rather is operated remotely.

Figure 2:
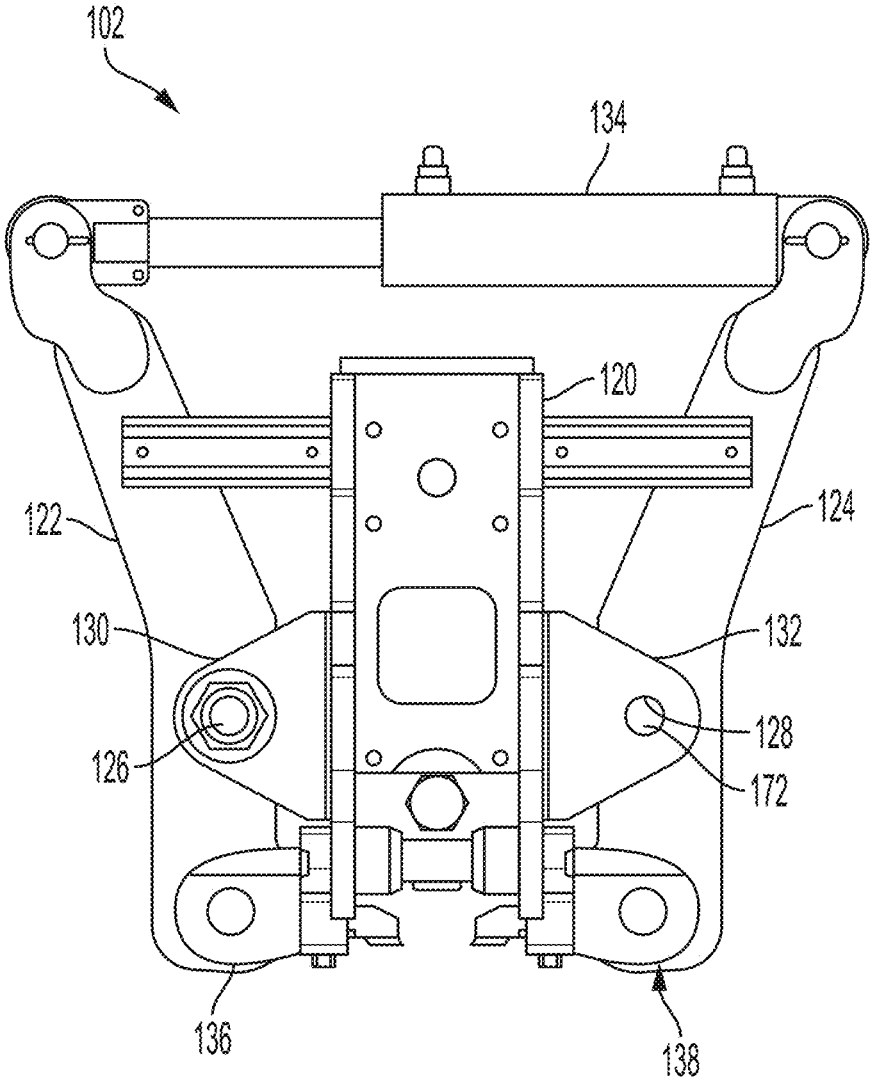
FIG. 2 illustrates a front view of a rail clamp assembly according to the present disclosure.

The rail clamp assembly 102 is shown more specifically in FIG. 2. The rail clamp assembly 102 includes a fixed central member 120 that may be coupled to the chassis 104. The rail clamp assembly 102 further includes a pair of arms 122, 124 that are operable to pivot about pivot points 126, 128 disposed through lugs 130, 132 extending from the central member 120. The lugs 130, 132 each include a pair of lug elements such that one of the lug elements is disposed on a first side of the arm and the other lug element is disposed on a second, opposing side of the corresponding arm. A cylinder 134 may be provided to operatively couple the arms 122, 124. The cylinder 134 may be actuated to impart movement to the arms 122, 124 about pivot points 126, 128. Gripping tool assemblies 136, 138 are disposed at lower ends of the pivot arms 122 to provide gripping tools for gripping rail as will be further described.

Figure 3:
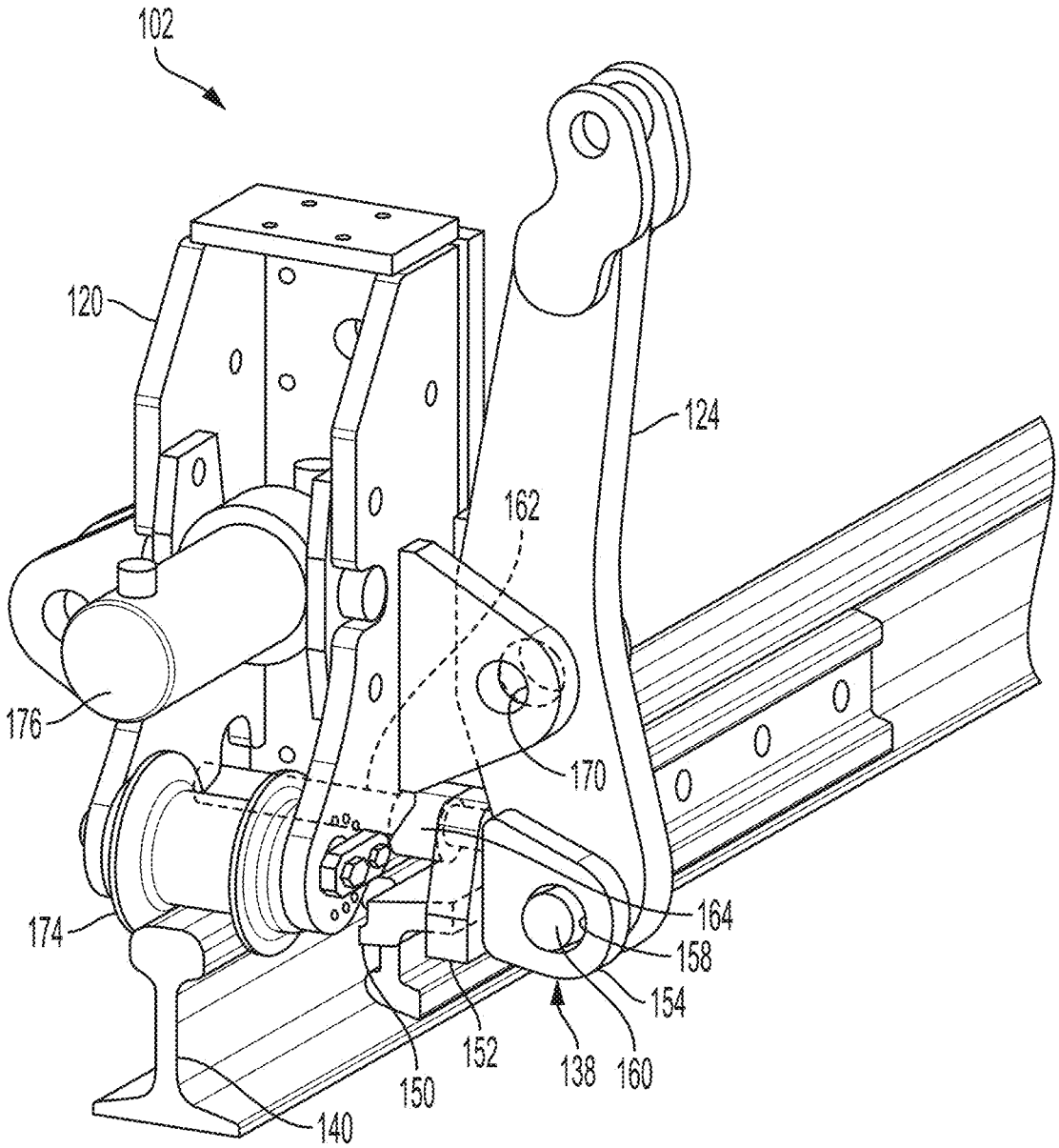
FIG. 3 illustrates a perspective view of one side of the rail clamp assembly of FIG. 2.
Figure 4:
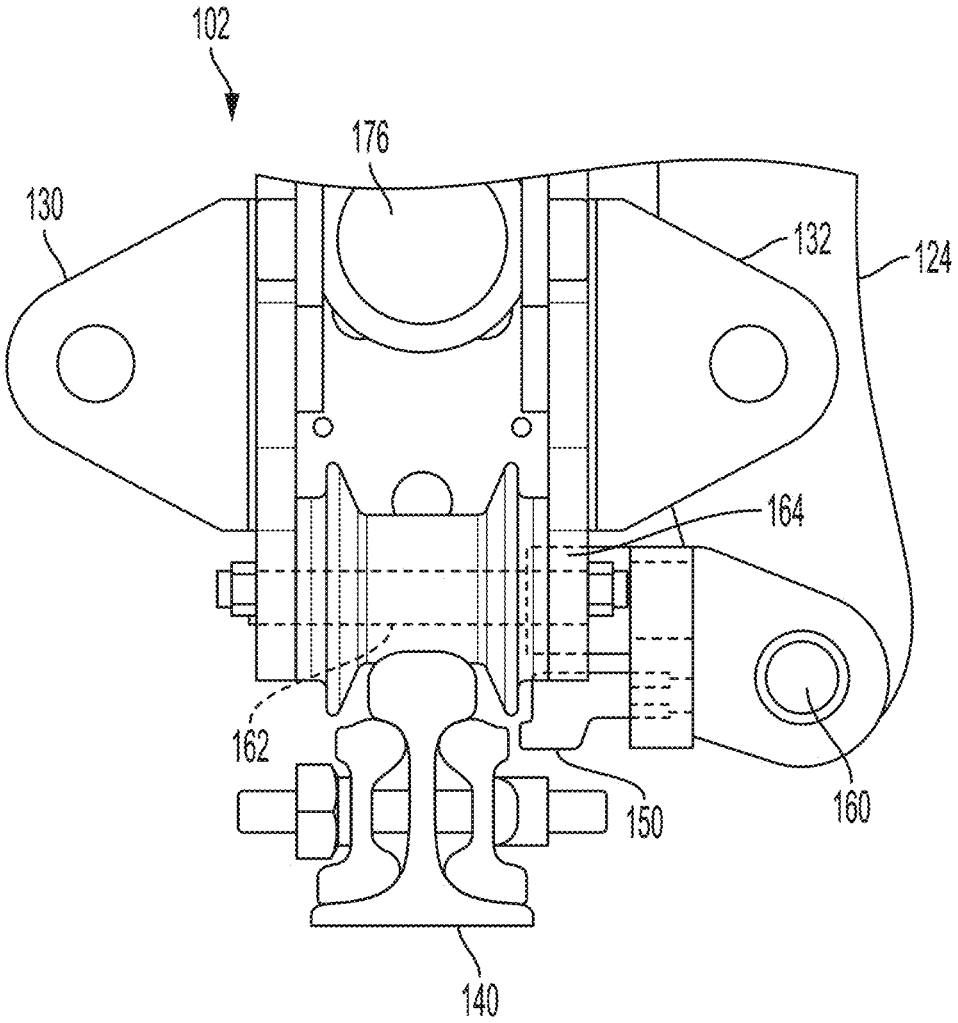
FIG. 4 illustrates a front view of the portion of the rail clamp assembly in FIG. 3.
Figure 5:
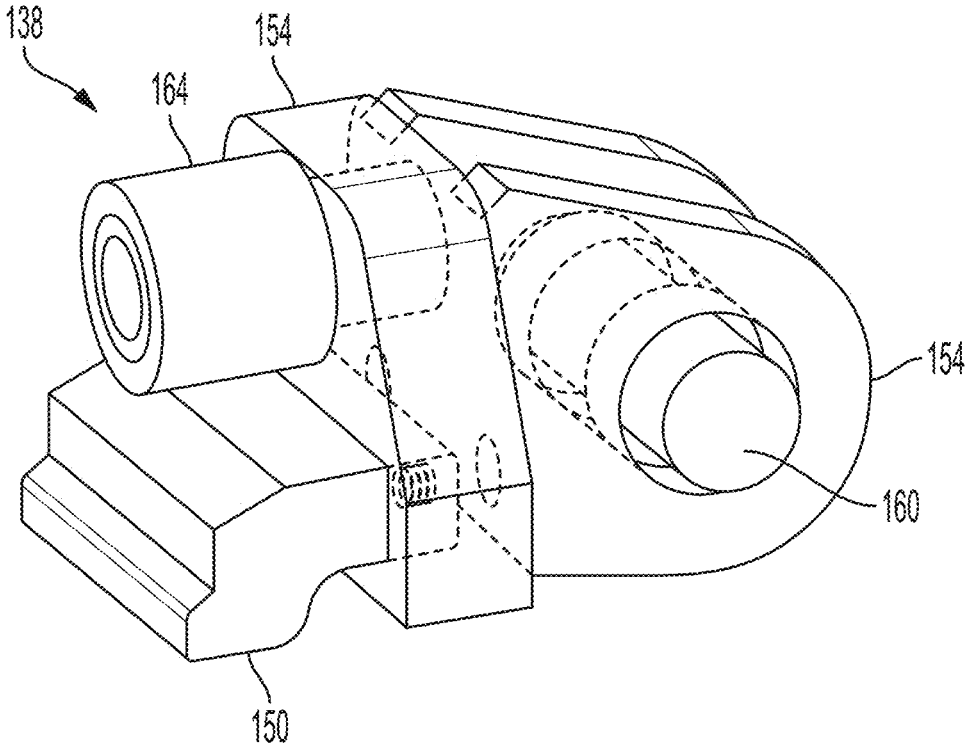
FIG. 5 illustrates a perspective view of the gripping tool assembly of the rail clamp assembly in FIG. 3.

FIGS. 3 and 4 illustrate a perspective view and a front view, respectively, of a portion of the rail clamp assembly 102 showing only one arm 124 and gripping tool assembly 138 for the purposes of clarity. FIG. 5 illustrates a perspective view of the gripping tool assembly 138. It will be appreciated that the below-described elements will include similar mirror-image elements disposed on the opposing side of a rail 140.

The gripping tool assembly 138 includes a rail clamp tip 150 coupled to the arm 124 via a tip holder 152 and a first connector 154 disposed on a first side of the arm and a second connector (not shown) disposed on a second, opposing side of the arm. In some embodiments, the rail clamp tip 150 may be mechanically coupled to the tip holder 152 via a fastener, such as a screw or the like. Similarly, the tip holder 152 may be mechanically coupled to the first and second connectors 154.

Each connector 154 includes a slot 158, one of which is shown in FIG. 3 as being disposed through the first connector portion. The slots defined through the connectors 154 are adapted to align with a corresponding slot defined through a lower portion of the arm 124. As such, a pin 160 may be disposed through the slots of the connectors 154 and the slot of the arm 124 to thereby couple the rail clamp tip 150, tip holder 152 and connectors 154 to the arm 124. While not depicted, the pin 160 may be disposed within a bushing and is therefore permitted to experience movements in the substantially vertical direction (i.e., up/down directions), which assists with achieving the desired straight line movement of the rail clamp tip 150 as will be described.

The rail clamp assembly 102 further includes a guide rod 162 that is coupled to the tip holder 152 via a receiver element 164. In some embodiments, the receiver element 164 is mechanically coupled to the tip holder 152. While not depicted, a bushing is disposed within the receiver element 164 and the guide rod 162 is received into the bushing. As depicted, the guide rod 162 is positioned in a substantially horizontal position above the rail 140. As the guide rod 162 is operatively coupled to the tip holder 152 and thus the rail clamp tip 150, the rail clamp tip, in practice, moves in a straight line or in a horizontal plane, and is guided by the guide rod during such movement. As discussed above, movement of the pin 160 in the up/down direction further assists with straight line movement of the rail clamp tip when the arm 124 pivots about the pivot point 128.

To facilitate pivot of the arm 124 about the pivot point 128, the lug 132 (comprised of two lug elements as discussed above) includes slots (one of which 170 is depicted) defined therein for matching up with a corresponding slot defined through the arm 124. As shown in FIG. 2, a connector 172, such as a pin or the like, may be disposed through the slot to thereby couple the arms to the lugs and provide for the pivot point 128 for the arm 124 to move about the lug 132. Further shown in FIG. 3 is a rail wheel 174 that is coupled to the fixed central member 120 of the rail clamp assembly 102 to thereby permit movement of the rail clamp assembly along the rail 140. In some embodiments, a cylinder 176 may also be provided to impart longitudinal movement of the rail clamp assembly 102 along the rail 140 as desired.

Figure 6:
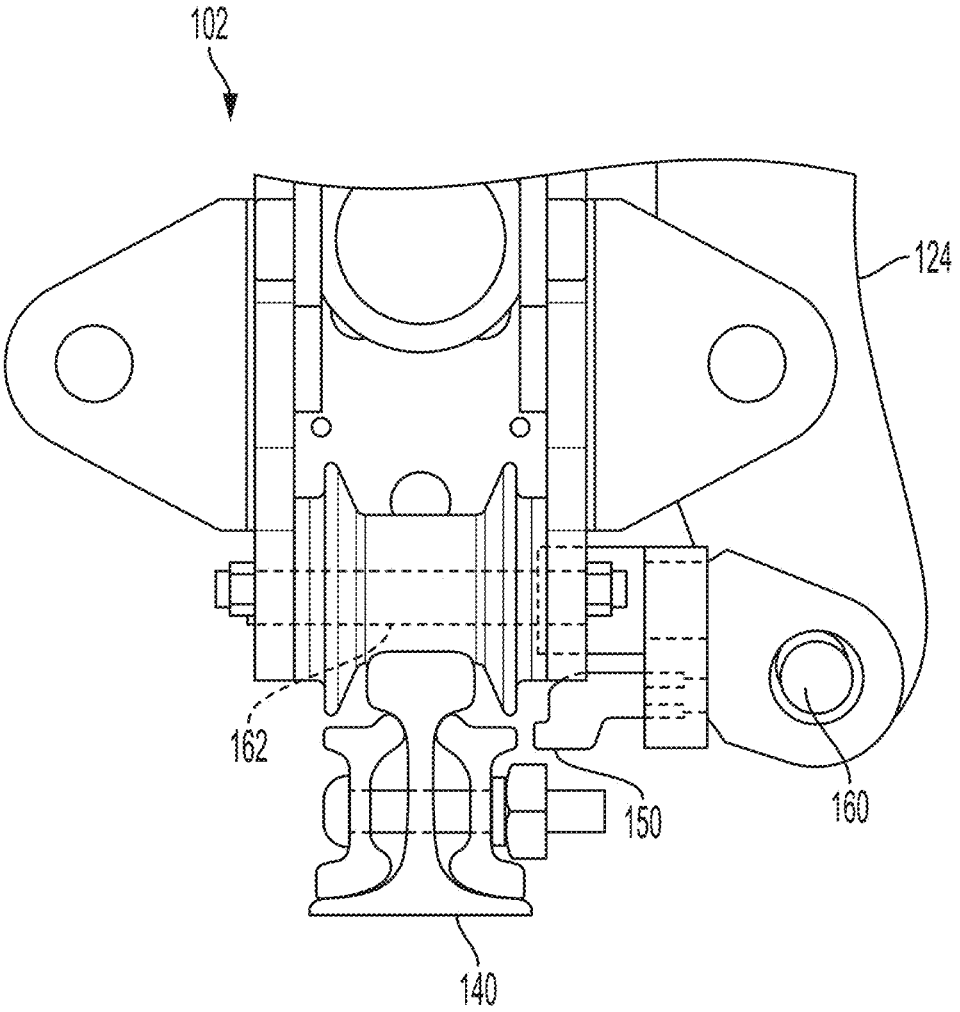
FIGS. 6-8 illustrate front views of the gripping tool in various positions relative to a rail.
Figure 7:
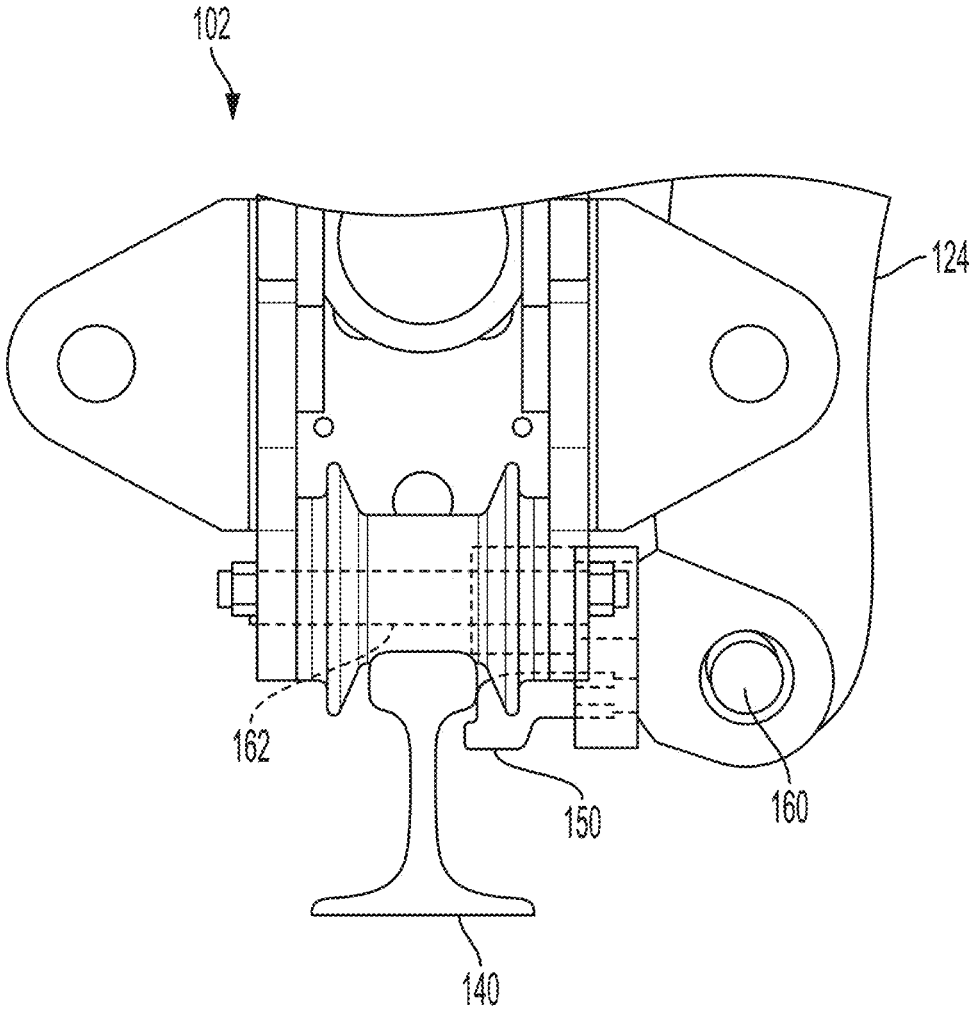
Figure 8:
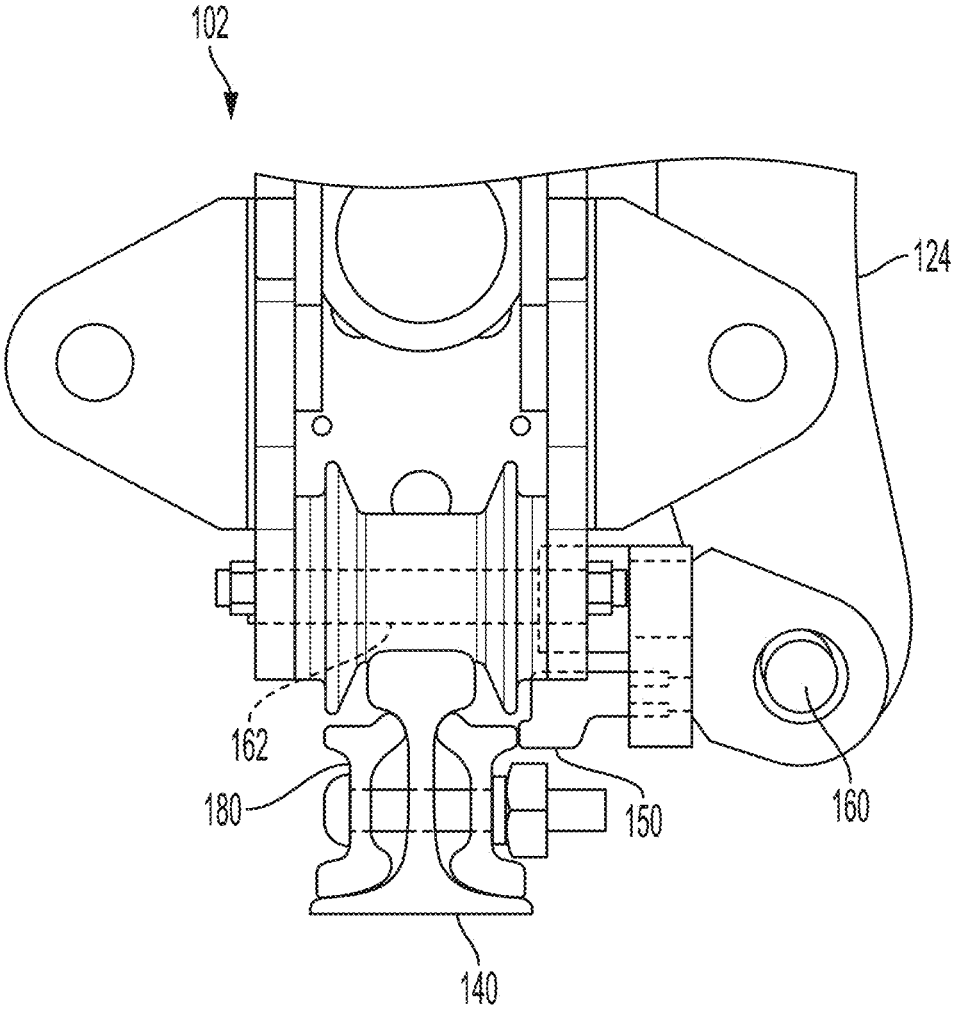

In some embodiments, the rail clamp tip 150 has a stepped profile. Such a profile is advantageous in situations where the rail clamp is used for both clamping a rail having a traditional I-beam profile and for clamping a portion of rail having a joint bar. With reference to FIGS. 6-8, the rail clamp assembly 102 may first have an open position (FIG. 6) in which the rail clamp tip 150 is not engaged with any portion of the rail 140. At areas of the rail 140 having a traditional I-beam profile (FIG. 7), the rail clamp assembly 102 may be operated to engage the rail clamp tip 150 with the rail 140 to thereby clamp the rail 140 and hold it in place. While only one arm 124 is shown in FIG. 7, it is to be appreciated that a mirror image arm and gripping tool assembly with rail clamp tip is provided on the opposed side of the rail such that actuation of the cylinder 134 imparts a squeezing motion to the gripping tool assemblies such that the respective rail clamps tips engage the rail 140 on opposing sides thereof. As is apparent from a comparison of FIGS. 6 and 7, the rail clamp tip 150 is moved in a horizontal plane towards the rail 140 as assisted by the pin 160 and guide rod 162. In this arrangement, the upper portion of the stepped profile of the rail clamp tip 150 engages the rail 140. With reference to FIG. 8, the rail clamp assembly 102 may also be operated to engage a joint bar 180 disposed about the rail 140. As is apparent from a comparison of FIGS. 6 and 8, the rail clamp tip 150 is moved in a horizontal plane towards the joint bar 180 as assisted by the pin 160 and guide rod 162. In the arrangement of FIG. 8, the lower portion of the stepped profile of the rail clamp tip 150 may engage the joint bar 180.

Figure 9:
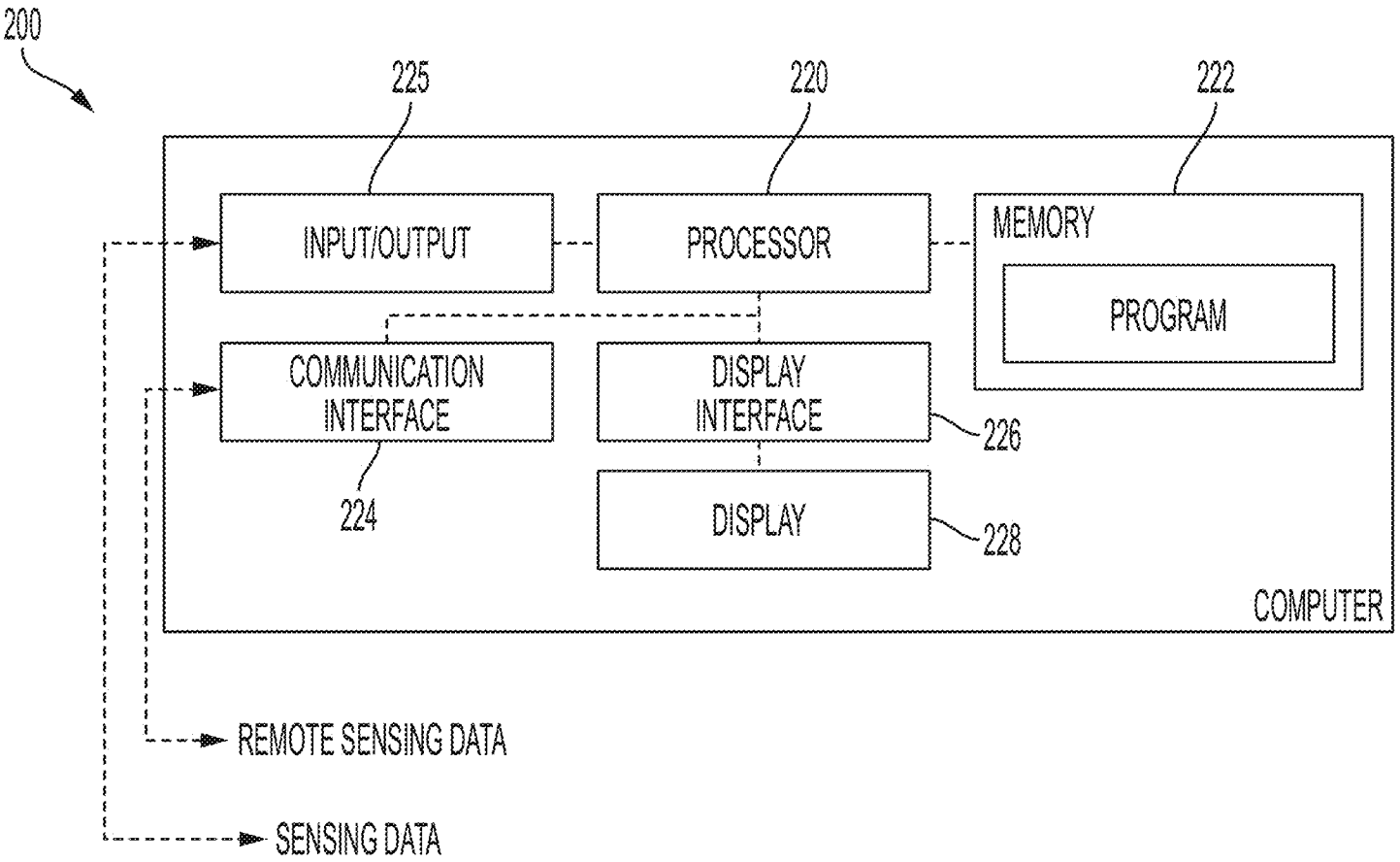
FIG. 9 illustrates a computing system associated with the rail clamp assembly.

Referring to FIG. 9, the rail vehicle 100 may be equipped with a computing system may take the form of a computer or data processing system 200 that includes a processor 220 configured to execute at least one program stored in memory 222 for the purposes of performing one or more of the processes disclosed herein. The processor 220 may be coupled to a communication interface 224 to receive remote sensing data, such as detection of a tie, as well as transmit instructions to receivers distributed throughout the rail vehicle 100, such as to the workheads to commence rail clamping operations. The processor 220 may also receive and transmit data via an input/output block 225. In addition to storing instructions for the program, the memory may store preliminary, intermediate and final datasets involved in techniques that are described herein. Among its other features, the computing system 200 may include a display interface 226 and a display 228 that displays the various data that is generated as described herein. It will be appreciated that the computing system 200 shown in FIG. 9 is merely exemplary in nature and is not limiting of the systems and methods described herein.

While various implementations in accordance with the disclosed principles have been described above, it should be understood that they have been presented by way of example only, and are not limiting. Thus, the breadth and scope of the implementations should not be limited by any of the above-described exemplary implementations, but should be defined only in accordance with the claims and their equivalents issuing from this disclosure. Furthermore, the above advantages and features are provided in described implementations, but shall not limit the application of such issued claims to processes and structures accomplishing any or all of the above advantages.

What is claimed is:

1. A rail vehicle comprising:

a chassis; and a rail clamp assembly coupled to the chassis, the rail clamp assembly including:

a fixed central member;

a pair of lugs, each lug extending outwardly from opposing sides of the fixed central member;

a pair of arms coupled to the fixed central member about respective pivot points to permit rotation of the arms about the pivot points, where the pair of arms are respectively coupled to the pair of lugs;

a pair of gripping tool assemblies coupled to respective lower portions of the pair of arms; and a guide rod extending between the pair of gripping tool assemblies and configured to couple the pair of gripping tool assemblies to one another.

2. The rail vehicle of claim 1, further comprising a cylinder coupled between upper portions of the arms, the cylinder being capable of imparting a squeezing motion to the arms.

3. The rail vehicle of claim 1, wherein each gripping tool assembly includes a rail clamp tip coupled to a respective arm of the pair of arms via a connector.

4. The rail vehicle of claim 3, wherein the connector is coupled to the respective arm via a pin.

5. The rail vehicle of claim 4, wherein the pin is disposed in a bushing to allow for vertical movement of the pin.

6. The rail vehicle of claim 3, wherein the rail clamp tip has a stepped profile.

7. The rail vehicle of claim 1, wherein the guide rod is disposed vertically above a rail when the rail vehicle operates on the rail.

8. A rail clamp assembly disposed on a rail vehicle, the rail clamp assembly comprising:

a fixed central member;

a pair of arms comprising:

a first arm pivotably coupled to a first side of the fixed central member; and a second arm pivotably coupled to a second side of the fixed central member that is opposite the first side;

a pair of gripping tool assemblies comprising:

a first gripping tool assembly coupled to a lower portion of the first arm; and a second gripping tool assembly coupled to a lower portion of the second arm, the first and second gripping tool assemblies configured to engage opposing sides of a rail; and a guide rod comprising a first end, a second end, and a longitudinal axis extending between the first and second end;

wherein the first end of the guide rod is coupled to the first gripping tool assembly and the second end of the guide rod is coupled to the second gripping tool assembly to couple the first and second gripping tool assemblies together.

9. The rail clamp assembly of claim 8, further comprising a cylinder coupled between upper portions of the pair of arms, the cylinder being configured to impart a squeezing motion to the pair of arms.

10. The rail clamp assembly of claim 8, wherein each gripping tool assembly includes:

a rail clamp tip having a stepped profile; and a connector coupled to the rail clamp tip.

11. The rail clamp assembly of claim 10, wherein:

a first portion of the connector is coupled to the respective arm via a pin; and a second portion of the connector is coupled to the guide rod.

12. The rail clamp assembly of claim 11, wherein the pin is disposed in a bushing to allow for vertical movement of the pin.

13. The rail clamp assembly of claim 8, further comprising a rail wheel coupled to the fixed central member.

14. The rail clamp assembly of claim 8, wherein the guide rod is disposed vertically above a rail when the rail vehicle operates on the rail.

15. The rail clamp assembly of claim 8, wherein:

the first gripping tool assembly includes a first receiver element configured to receive the first end of the guide rod; and the second gripping tool assembly includes a second receiver element configured to receive the second end of the guide rod.

16. A method for performing a rail clamping operation on rail, comprising:

providing a rail vehicle having a chassis and a rail clamp assembly coupled to the chassis, the rail clamp assembly having;

a fixed central member;

a pair of lugs, each lug extending outwardly from opposing sides of the fixed central member;

a pair of arms coupled via an actuator, and the pair of arms rotatable coupled to the fixed central member via the pair of lugs;

gripping tool assemblies disposed at respective lower portions of the arms, the gripping tool assemblies being coupled to a guide rod; and actuating the actuator to impart a squeezing motion to the arms such that the gripping tool assemblies move toward the rail in a substantially horizontal plane.

17. The method of claim 16, wherein the rail has an I-beam configuration and each gripping tool assembly includes a rail clamp tip having a stepped profile in which a lower portion of the stepped profile projects beyond an upper portion of the stepped profile, the method further comprising engaging the rail clamp tips with the rail via the upper portion of the rail clamp tips.

18. The method of claim 16, wherein the rail includes a joint bar and each gripping tool assembly includes a rail clamp tip having a stepped profile in which a lower portion of the stepped profile projects beyond an upper portion of the stepped profile, the method further comprising engaging the rail clamp tips with the joint bar via the lower portion of the rail clamp tips.

* * * * *